US005435258A

United States Patent [19]

Piette

[11] Patent Number: 5,435,258

[45] Date of Patent: Jul. 25, 1995

[54] METHOD AND APPARATUS FOR REGENERATING DESICCANTS

[76] Inventor: Michel Piette, 490 des Cèdres C.P. 956, Ste-Brigide d'Iberville, Quûbec, Canada, J0J 1X0

[21] Appl. No.: 263,386

[22] Filed: Jun. 22, 1994

[51] Int. Cl.[6] ..... F23B 7/00

[52] U.S. Cl. ..... 110/341; 110/236; 110/246

[58] Field of Search ..... 110/236, 346, 246, 226, 110/341; 432/107, 112

[56] References Cited

U.S. PATENT DOCUMENTS

| | | | |
|---|---|---|---|
| 2,518,409 | 8/1950 | Williamson | 34/9 |
| 3,275,549 | 9/1966 | Crabb et al. | 210/30 |
| 3,412,697 | 11/1968 | Matteini | 110/246 |
| 3,688,709 | 9/1972 | Sheffield | 110/8 R |
| 4,179,399 | 12/1979 | Lichtenberger et al. | 252/411 |
| 4,205,459 | 6/1980 | Koseki et al. | 34/166 |
| 4,408,547 | 10/1983 | Autere | 110/246 X |
| 4,527,398 | 7/1985 | Schaetzle | 62/94 |
| 4,592,288 | 6/1986 | Palmer | 110/236 |
| 4,667,417 | 5/1987 | Graser et al. | 34/9 |
| 4,934,929 | 6/1990 | Kelly | 432/59 |
| 4,970,970 | 11/1990 | Avery | 10/246 |
| 4,974,336 | 12/1990 | Hahn | 34/22 |
| 5,086,716 | 2/1992 | Lafser | 110/345 |
| 5,170,726 | 12/1992 | Brashears et al. | 110/236 |

*Primary Examiner*—Denise L. Gromada

[57] ABSTRACT

In a method and apparatus for regenerating particles of desiccant rendered ineffective by at least one contaminant capable of being burned, the particles of desiccant are placed into a hollow container formed with a cylindrical perforated wall, the hollow container is rotated about the geometrical axis of the cylindrical wall to continuously mix the particles of desiccant, and combustion flames are applied to the underside of the cylindrical perforated wall whereby these flames are applied directly to the particles of desiccant being mixed through the perforations of the cylindrical wall to burn and thereby remove the contaminant from the particles of desiccant.

20 Claims, 1 Drawing Sheet

METHOD AND APPARATUS FOR REGENERATING DESICCANTS

BACKGROUND OF THE INVENTION

1. Field of the Invention

The present invention relates to a method and apparatus for removing from a granular material at least one substance capable of being burned. More specifically, the present invention is concerned with a method and apparatus for regenerating granular desiccative material rendered ineffective by at least one contaminant.

2. Brief Description of the Prior Art

As well known to those of ordinary skill in the art, granular desiccative material (desiccants) are used in many applications for absorbing moisture. With time, desiccants become contaminated by water, oil or any other substance to which they are exposed. When they are saturated with contaminant, desiccants are ineffective to absorb moisture. Regeneration thereof is then required.

A prior art method for regenerating granular desiccants consists of immersing the contaminated desiccative material into baths of solvent. Of course, the solvent is selected in function of the contaminant or contaminants involved. Repeated baths may be required to dislodge the contaminant(s), the desiccant being dried after each bath. Another drawback of this prior art method is that the solvent itself has to be recycled and the sludge disposed of.

When the contaminant is formed of simple molecules, a bath containing a compound reacting with those molecules while dislodging them from the desiccant can be used. It is also possible that the contaminant be dislodged in water baths, when water is more easily absorbed by the desiccant than the contaminant.

When the contaminant(s) are volatile or have a low temperature of evaporation, another prior art method consists of using a kiln or furnace to heat the desiccative material to thereby evaporate the contaminant(s). The gaseous emanations must then be analyzed to determine whether they have to be recovered and destroyed, or they can be released into the atmosphere.

U.S. Pat. No. 5,086,716 granted to Lafser, Jr. on Feb. 11, 1992, proposes a rotary kiln for disposing of solid waste and recovering a portion of the energy and materials value of the waste. The kiln includes an inclined, cylindrical vessel having a higher end supplied with waste material. A burner is installed at the lower end of the cylindrical vessel to heat gases in the interior of that vessel and thereby process the waste material moving from the higher end to the lower end of the inclined vessel. Accordingly, the temperature progressively increases from the lower end to the higher end of the cylindrical vessel. The kiln of U.S. Pat. No. 5,086,716 presents the two following drawbacks:

- the kiln of U.S. Pat. No. 5,086,716 exposes partially the particles of waste material to the flame of the burner, produces a temperature which is not constant along the cylindrical vessel and continuously moves the waste material along the cylindrical vessel whereby the waste material is not processed uniformly; and
- the energy consumption is increased by the position of the burner above the material to be processed; heat raises in the upper portion of the cylindrical vessel of the kiln where there is no material to be processed and is evacuated through the higher end of the vessel.

OBJECTS OF THE INVENTION

A general object of the present invention is therefore to eliminate the above discussed drawbacks of the prior art.

Another object of the invention is to provide a method and apparatus capable of regenerating desiccants without solvent baths.

A third object of the present invention is to provide a method and apparatus capable of applying flames uniformly and directly to the particles of a granular material in view of burning at least one substance to be removed from that granular material.

A fourth object of the present invention is to provide a method and apparatus capable of regenerating granular desiccative material having particles contaminated at different levels, or saturated with different contaminants, for example water and oil, with which the quality of the regenerated product is uniform and optimal.

SUMMARY OF THE INVENTION

More specifically, in accordance with the present invention, there is provided a method of removing from granular material at least one substance capable of being burned, comprising the steps of:

placing the granular material into a hollow container formed with perforations;

rotating the hollow container whereby the granular material is mixed in the hollow container; and applying flames to the rotating hollow container whereby these flames are applied directly to the granular material being mixed through the perforations to burn and thereby remove the substance from the granular material.

The present invention also relates to an apparatus for removing from granular material at least one substance capable of being burned, comprising:

a hollow container in which the granular material is placed, this hollow container being formed with perforations;

means for rotating the hollow container whereby the granular material is mixed in the hollow container; and means for applying flames to the rotating hollow container whereby these flames are applied directly to the granular material being mixed through the perforations to burn and thereby remove the substance from the granular material.

The granular material may comprise particles of desiccant to be regenerated, rendered ineffective by at least one contaminant capable of being burned and constituting the substance to be removed.

Direct contact of the flames with the particles of contaminated desiccant enables gradual combustion and elimination of the contaminant without formation of film on the particles. Also, the use of a rotating perforated container enable uniform application of the flames to the particles and a uniform temperature of these particles.

In accordance with a preferred embodiment, the hollow container comprises a perforated cylindrical wall having a geometrical axis, the hollow container is rotated about this geometrical axis disposed horizontally, and the flames are applied to the underside of the perforated cylindrical wall.

In accordance with another preferred embodiment, the granular material comprises particles having substantially a given diameter, the perforations have dimensions smaller than that given diameter, and broken particles of dimensions smaller than the dimensions of the perforations are withdrawn from the granular material through these perforations.

The hollow container may be slightly inclined to produce an axial flow of granular material in that hollow container.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

Figure 1:
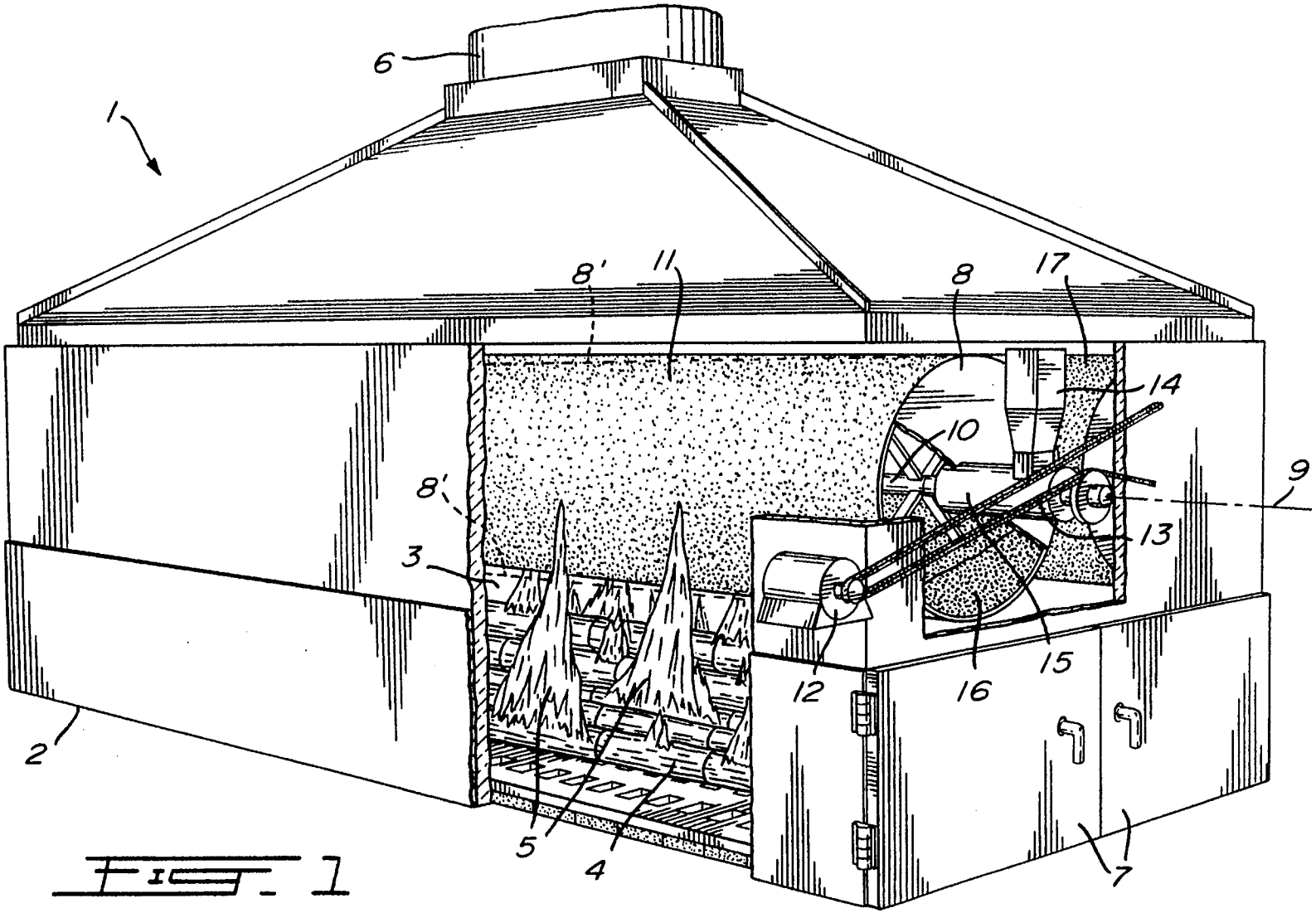
FIG. 1 is a perspective view of the preferred embodiment of an apparatus according to the invention for regenerating granular desiccative material.

As this will be explained in the following description, the method according to the present invention consists of burning the contaminants accumulated in granular desiccants. This method destroys the contaminants in a single step without requiring recycling of solvent or recovery of the contaminants. The method according to the invention can be easily adapted to different types of desiccants and contaminants, as long as the level of temperature required does not deteriorate the desiccant and the gaseous emanations respect the governmental regulations.

Also, although the preferred embodiment of the present invention will be described hereinafter with reference to desiccants it should be kept in mind that, more generally, the method of the present invention can be used to remove from granular material at least one substance capable of being burned.

The desiccant regenerating method according to the invention is carried out by means of the apparatus 1 of FIG. 1.

The apparatus 1 of FIG. 1 comprises a furnace 2 having a combustion chamber 3 in which logs such as 4 are burned to produce combustion flames 5. Smoke from combustion of the logs 4 is evacuated from the combustion chamber 3 through a chimney 6. The furnace 2 is further provided with front doors 7 to supply the combustion chamber 3 with logs 4. This type of furnace is well known to those of ordinary skill in the art and therefore will not be further described in the present specification.

A cylindrical hollow container 8 is rotatively mounted about its geometrical longitudinal axis 9 through a shaft 10. More specifically, the shaft 10 and therefore the hollow container 8 are rotated about the geometrical axis 9 through an electric motor 12 and a belt 13. The container 8 is formed with a cylindrical wall 11 perforated over its entire surface. To supply contaminated granular desiccative material 16 in the hollow container 8, a tubular member 15 is mounted coaxial to the shaft 10 for interconnecting a hopper 14 with the inside of the hollow container 8. More specifically, contaminated desiccative material is poured into the hopper 14 and is transferred from the hopper 14 to the hollow container 8 through the tubular member 15. An endless screw (not shown) can be mounted on the rotary shaft 10 in the tubular member 15 to facilitate this transfer. The end of the hollow container 8 opposite the hopper 14 can be opened to withdraw regenerated desiccate material through another hopper system (not shown).

As illustrated in FIG. 1, the hollow container 8 is mounted and rotated above the flames 5 which are therefore applied to the outside of the cylindrical wall 11, under the hollow container 8. As the hollow container 10 is rotated at constant speed, the granular desiccative material is continuously mixed and uniformly heated and exposed to the combustion flames 5 through the perforations of the cylindrical wall 11 to ensure efficient combustion of the contaminant(s).

Of course many cylindrical hollow containers such as 8 can be rotatively mounted in the combustion chamber 3 above the flames 5. FIG. 1 illustrates two laterally adjacent containers 8 and 17.

To burn and destroy a given contaminant, a corresponding, required temperature is reached until the contaminant is completely burned. Direct contact of the flames 5 with the particles of contaminated desiccant enables gradual combustion and elimination of the contaminant without formation of film on the particles. For example, when a granular desiccant contaminated with oil is heated, even at very high temperature, without direct contact between the flames and the particles of desiccant, the oil tends to harden into a film on the surface of each particle. The absorption capabilities of the desiccant are, if not completely annihilated, greatly reduced by this film. As mentioned hereinabove, direct contact of the flames with the desiccative material completely eliminates this film.

Combustion of the contaminant also produces smoke and combustion gases evacuated from the chamber 3 through the chimney 6.

The method and apparatus according to the present invention are well suited to regenerate a granular desiccant having particles contaminated at different levels, or saturated with different contaminants such as water and oil. The uniform temperature and the uniform contact between the flames and the particles of desiccant can be maintained during a time period sufficient to obtain a regenerated product of uniform, optimal quality.

As the temperature in the hollow container 8 is uniform and the contact between the flames 5 and the particles of contaminated desiccant is also uniform a continuous axial flow of granular desiccant can be established in the cylindrical hollow container 8, for example by slightly inclining that container (see 8' in FIG. 1). However, it is important that the time during which each particle of desiccant is exposed to the temperature inside the container and to the flames be the same and sufficient to regenerate the most contaminated particles whereby a regenerated product of uniform quality is obtained.

Tests have demonstrated that the absorption capability of new desiccative material is about 23.4%. The absorption capability of desiccant regenerated using the method of U.S. Pat. No. 5.086,716 is about 16.2%. Finally, granular desiccant regenerated by the method and apparatus according to the invention presents an absorption capability of about 23.9%. These tests demonstrate the superiority of the desiccant regenerating method according to the present invention.

To completely burn and eliminate the contaminants, the desiccant being regenerated must reach a temperature of the order to 1200° F. Another advantage of the present invention is that the use of a perforated hollow cylindrical container 8 enables installation of the heat source under the desiccative material to thereby save energy as the heat produced follows its natural course toward the chimney 6 through the desiccative material being regenerated.

In a granular desiccant to be regenerated, 10% to 20% of the particles have been crushed or broken during use, handling and/or transport of the desiccant. The resulting dust or broken particles should be removed from the regenerated desiccative material to prevent problems associated therewith upon subsequent use of the regenerated product. For example, in an air filter, the dust and broken particles will accumulate at the bottom of the filter and will compact to impede passage of air.

For example, if the desiccant is formed of particles having an average diameter of about ⅛" the cylindrical wall 11 may be formed with perforations having a diameter of 1/16" to withdraw through these perforations the dust and broken particles smaller than 1/16" as the container 10 is rotated. The dust is consumed by the flames 5 and the broken particles can be easily recovered at the bottom of the combustion chamber 3. Therefore, another advantage of the method and apparatus according to the present invention is that no additional operation is required to withdraw the dust and broken particles form the granular desiccant being regenerated.

Although the present invention has been described hereinabove by way of a preferred embodiment thereof, this embodiment can be modified at will, within the scope of the appended claims, without departing from the spirit and nature of the subject invention.

What is claimed is:

1. An absorbent material regenerating method for regenerating particles of absorbent material having absorbed at least one substance capable of being burned, comprising the steps of:

placing the particles of absorbent material into a hollow container formed with perforations;

rotating the hollow container whereby the particles of absorbent material are mixed in said hollow container; and applying flames to the rotating hollow container whereby said flames are applied directly to the particles of absorbent material being mixed through said perforations to burn and thereby remove said substance from the absorbent material.

2. The absorbent material regenerating method of claim 1, wherein said hollow container comprises a perforated cylindrical wall having a geometrical axis, wherein said rotating step comprises rotating said hollow container about said geometrical axis, and wherein said flame applying step comprises applying said flames to said perforated cylindrical wall.

3. The absorbent material regenerating method of claim 2, wherein said rotating step comprises rotating said hollow container with said geometrical axis substantially horizontal, and wherein said flame applying step comprises applying said flames to the underside of the hollow container.

4. The absorbent material regenerating method of claim 2, further comprising the step of producing an axial flow of absorbent material in said hollow container.

5. A method of removing from granular material at least one substance capable of being burned, comprising the steps of:

placing the granular material into a hollow container formed with perforations;

rotating the hollow container whereby the granular material is mixed in said hollow container; and applying flames to the rotating hollow container whereby said flames are applied directly to the granular material being mixed through said perforations to burn and thereby remove said substance from the granular material;

wherein the granular material comprises particles having substantially a given diameter, and wherein said perforations have dimensions smaller than said given diameter, said method further comprising the step of withdrawing from the granular material and through said perforations, broken particles of dimensions smaller than the dimensions of said perforations.

6. A method of regenerating particles of desiccant rendered ineffective by at least one contaminant capable of being burned, comprising the steps of:

placing said particles of desiccant into a hollow container formed with perforations;

rotating the hollow container whereby said particles of desiccant are mixed in said hollow container; and applying flames to the rotating hollow container whereby said flames are applied directly to said particles of desiccant being mixed through said perforations to burn and thereby remove said contaminant from said particles of desiccant.

7. A method of regenerating particles of desiccant as recited in claim 6, wherein said hollow container comprises a perforated cylindrical wall having a geometrical axis, wherein said rotating step comprises rotating said hollow container about said geometrical axis, and wherein said flame applying step comprises applying said flames to said perforated cylindrical wall.

8. A method of regenerating particles of desiccant as recited in claim 7, wherein said rotating step comprises rotating said hollow container with said geometrical axis substantially horizontal, and wherein said flame applying step comprises applying said flames to the underside of the hollow container.

9. The substance removing method of claim 7, further comprising the step of producing an axial flow of particles of desiccant in said hollow container.

10. A method of regenerating particles of desiccant as recited in claim 6, wherein said particles of desiccant have substantially a given diameter, and wherein said perforations have dimensions smaller than said given diameter, said method further comprising the step of withdrawing through said perforations broken particles of desiccant having dimensions smaller than the dimensions of said perforations.

11. An absorbent material regenerating apparatus for regenerating particles of absorbent material having absorbed at least one substance capable of being burned, comprising:

a hollow container in which the particles of absorbent material are placed, said hollow container being formed with perforations;

means for rotating the hollow container whereby the particles of absorbent material are mixed in said hollow container; and means for applying flames to the rotating hollow container whereby said flames are applied directly to the particles of absorbent material being mixed through said perforations to burn and thereby remove said substance from the particles of absorbent material.

12. The apparatus of claim 11, wherein said hollow container comprises a perforated cylindrical wall having a geometrical axis, wherein said rotating means comprises means for rotating said hollow container about said geometrical axis, and wherein said flame applying means comprises means for applying said flames to said perforated cylindrical wall.

13. The apparatus of claim 12, wherein said rotating means comprises means for rotating said hollow container with said geometrical axis substantially horizontal, and wherein said flame applying means comprises means for applying said flames to the underside of the hollow container.

14. The apparatus of claim 12, wherein said hollow container is slightly inclined to produce an axial flow of particles of absorbent material in said hollow container.

15. An apparatus for removing from granular material at least one substance capable of being burned, comprising:

a hollow container in which the granular material is placed, said hollow container being formed with perforations;

means for rotating the hollow container whereby the granular material is mixed in said hollow container; and means for applying flames to the rotating hollow container whereby said flames are applied directly to the granular material being mixed through said perforations to burn and thereby remove said substance from the granular material;

wherein the granular material comprises particles having substantially a given diameter, and wherein said perforations have dimensions smaller than said given diameter whereby broken particles of dimensions smaller than the dimensions of said perforations are withdrawn from the granular material through said perforations.

16. An apparatus for regenerating particles of desiccant rendered ineffective by at least one contaminant capable of being burned, comprising:

a hollow container in which said particles of desiccant are placed, said hollow container being formed with perforations;

means for rotating the hollow container whereby said particles of desiccant are mixed in said hollow container; and means for applying flames to the rotating hollow container whereby said flames are applied directly to said particles of desiccant being mixed through said perforations to burn and thereby remove said contaminant from said particles of desiccant.

17. An apparatus for regenerating particles of desiccant as recited in claim 16, wherein said hollow container comprises a perforated cylindrical wall having a geometrical axis, wherein said rotating means comprises means for rotating said hollow container about said geometrical axis, and wherein said flame applying means comprises means for applying said flames to said perforated cylindrical wall.

18. An apparatus for regenerating particles of desiccant as recited in claim 17, wherein said rotating means comprises means for rotating said hollow container with said geometrical axis substantially horizontal, and wherein said flame applying means comprises means for applying said flames to the underside of the hollow container.

19. An apparatus for regenerating particles of desiccant as recited in claim 17, wherein said hollow container is slightly inclined to produce an axial flow of particles of desiccant in said hollow container.

20. An apparatus for regenerating particles of desiccant as recited in claim 16, wherein said particles of desiccant have substantially a given diameter, and wherein said perforations have dimensions smaller than said given diameter whereby broken particles of desiccant having dimensions smaller than the dimensions of said perforations are withdrawn through said perforations.

* * * * *